United States Patent [19]

Simpson

[11] 4,030,752

[45] June 21, 1977

[54] LONGWALL MINING OF THICK UNDERGROUND MINERAL SEAMS

[75] Inventor: Terry Lee Simpson, Westminster, Calif.

[73] Assignee: Atlantic Richfield Company, Los Angeles, Calif.

[22] Filed: Mar. 8, 1976

[21] Appl. No.: 664,436

[52] U.S. Cl. ..... 299/11; 299/19

[51] Int. Cl.[2] ..... E21C 41/04

[58] Field of Search ..... 299/11, 19

[56] References Cited

UNITED STATES PATENTS 3,778,108 12/1973 Pennington et al. ..... 299/11

FOREIGN PATENTS OR APPLICATIONS 565,413 3/1958 Belgium ..... 299/11

*Primary Examiner*—Ernest R. Purser

*Attorney, Agent, or Firm*—Robert M. Betz

[57] ABSTRACT

In the mining of a thick underground mineral seam, parallel submain entries are developed at the top of the seam or at an upper level where a competent roof exists. Spaced apart parallel sets of panel entries are driven at right angles to these submain entries along a downwardly sloping path to the bottom of the seam. The entries are continued coincident with the bottom of the seam to any desired point at which their extremities are connected with bleeder entries so as to define a series of longwall panels. These panels are mined in retreat under the protection of advancing roof support structures so as to induce caving of overlying strata. After mining a series of panels in sequence in this manner, auxiliary sets of parallel development entries are driven in a downwardly sloping path beneath and substantially coextensive with the submains to enable recovery of a substantial percentage of the mineral beneath said submains by again longwalling in retreat at right angles to the first mining direction with sublevel caving.

9 Claims, 4 Drawing Figures

LONGWALL MINING OF THICK UNDERGROUND MINERAL SEAMS

BACKGROUND OF THE INVENTION

1. Field of the Invention

This invention relates to a layout and method for longwall mining of thick underground mineral seams and more particularly to a method for increasing the recovery from such an operation.

2. Description of the Prior Art

For the purposes of this application, a "thick seam" is defined as a seam too thick for maximum face productivity using existing mining systems. According to T. S. Cochrane in a paper entitled "Underground Mining of Thick Coal Seams" presented at the 74th Annual General Meeting of the CIM, Ottawa, Canada, productivity begins to fall off at between 6½ feet and 13 feed depending upon whether integrated mechanized systems or labor-intensive systems are used.

In the mining of thick underground mineral seams, for example of coal, a mining area may be initially blocked out by submain entries and bleeder entries between which parallel sets of so-called panel entries may be driven. Adjacent sets of panel entries are spaced apart so as to define a longwall panel therebetween which may be mined by known techniques, usually in retreat. If the longwall face is developed at the bottom of the coal seam and mined under the protection of advancing roof supports, additional coal is recovered by caving of overlying strata on the gob side behind such advancing roof structures.

At least two problems exist with existing layouts and methods of the character described. In the first place, if the submains are driven into the bottom of the seam, it may be difficult to protect these entries against roof fall because of the pressure of the overburden and the character of the roof formations. This additionally requires tunneling from the surface to a lower depth. Secondly, once the longwall panels have been mined in retreat for a percentage of the distance back toward submains, the operation usually ceases. No attempt is made to recover the coal lying above the submains, and this may represent a considerable loss.

Summary of the Invention

It is a general object of this invention to provide an improved mining layout and method for longwall mining of thick underground mineral seams.

It is a further object of this invention to provide a method of increasing the recovery in longwall mining of thick underground seams.

It is yet another object of this invention to provide a method for increasing the safety and productivity of a longwall mining operation in recovery of thick underground mineral seams.

In accordance with the preferred embodiment of this invention, main entries are driven from a portal to the boundaries of the mineral seam to be mined. Parallel submain development entries are driven from these main entries into the top of the seam for purposes of haulage and ventilation. Spaced apart sets of parallel panel entries are then driven at right angles to these submain development entries along a first sloping path to the bottom of the seam at which point these panel entries are continued along a second path coincident with said seam bottom. Finally, the extremities of the panel entries are connected by a bleeder entries so as to define a series of longwall panels to be mined sequentially. The longwall panels are then mined in retreat under the protection of advancing roof support structures so as to induce caving of overlying strata behind such structures. After the completion of the mining of a desired percentage of the longwall panels, auxiliary sets of development entries are driven in a sloping path beneath and substantially coextensive with the submain entries so as to block out a further longwall panel at the bottom of the seam. This additional panel is mined in retreat in a direction at right angles to the original mining direction and is again followed by induced sublevel caving of the overlying strata so that a significant portion of the mineral underlying the submains is also recovered.

DESCRIPTION OF THE PREFERRED EMBODIMENTS

Figure 1:
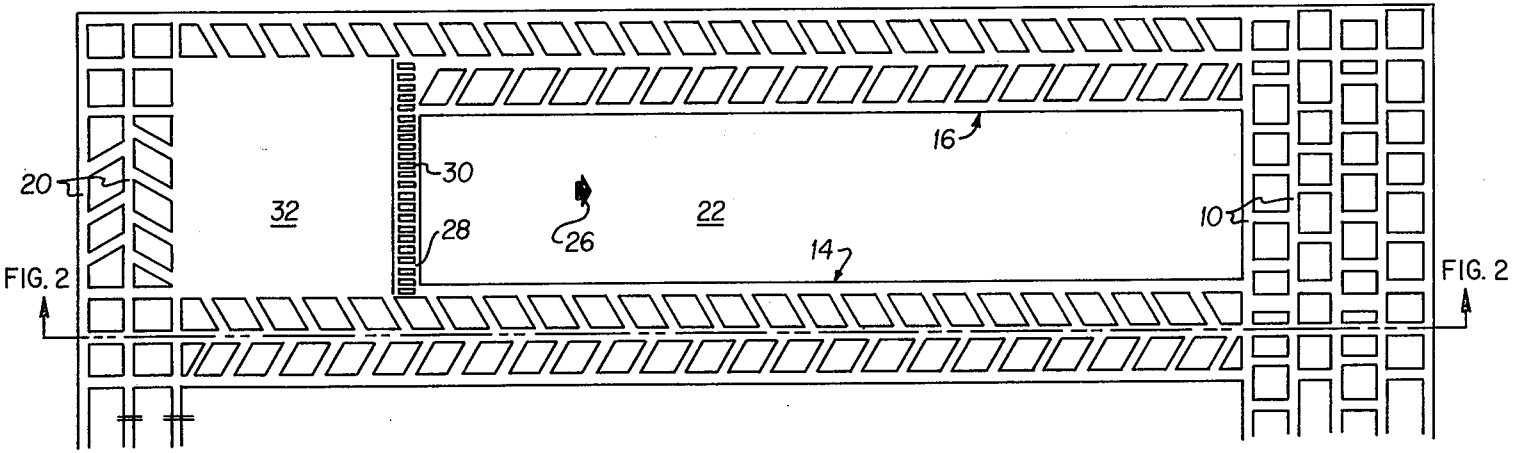
FIG. 1 is a plan view of a mine development layout in accordance with the first phase of a mining operation in accordance with this invention.
Figure 2:
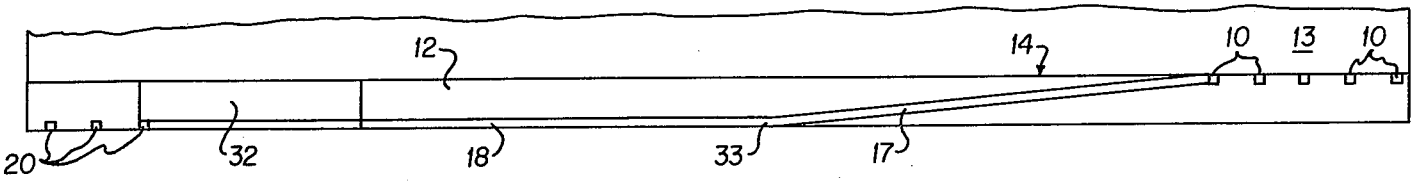
FIG. 2 is a sectional view taken along the line 2—2 in FIG. 1, illustrating the path of the main entries in accordance with this invention.

In the preferred method of the present invention and with particular reference to FIGS. 1 and 2, a series of parallel submain development entries 10 are driven along the top of a thick mineral seam 12, for example of coal, which it is assumed lies beneath a rock formation 13 which provides a competent roof for such entries. Parallel sets of panel entries, for example sets 14 and 16, are now driven into the seam 12 at right angles to submains 10 along a first path 17 until they reach the bottom of such seam. This first path 17 may be either downwardly or upwardly sloping or horizontal depending upon whether the seam 12 is flat or inclined. The panel entries 14 and 16 are thereafter continued along a second path 18 at such bottom level until the boundary of the area to be mined is reached. At their extremities, these panel entries may then be joined by parallel bleeder entries 20 so as to define a longwall panel 22.

As shwon in FIG. 1, the panel 22 is mined in the direction of retreat indicated by the arrow 26. A longwall face 28 is cut by means of a bidirectional shearer (not shown) under the protection of a row of advancing powered roof supports 30. The overlying strata of the seam 12 are induced to cave behind the advancing roof supports 30 so as to form a gob 32. Improvements in the mining of the longwall face 28 and in the recovery of caved coal in the gob 32 form the subject of separate inventions detailed respectively in application Ser. No. 664,437, entitled MINE ROOF SUPPORT METHOD IN LONGWALL MINING OF THICK MINERAL SEAMS and applicaton Ser. No. 664,438, entitled LONGWALL MINING WITH CHAIN PILLAR RECOVERY.

After retreat mining of the panel 22 has progressed to a desired extent, for example to the position 33, at which the first path 17 of the panel entries 14 and 16 is reached, the mining may be halted. At the conclusion of this initial phase of the operation, with particular reference to FIG. 3, it may be assumed that a portion of the seam 12 generally lying beneath the parallelogram ABCD has been allowed to cave and that the desired percentage of recovery of such caved coal has been achieved.

Figure 3:
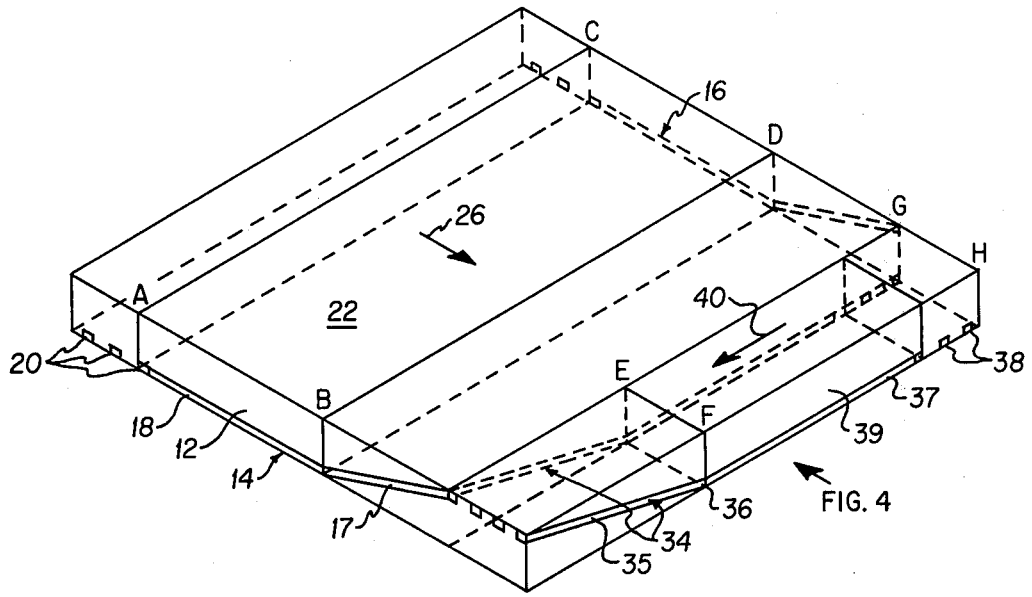
FIG. 3 is a diagrammatic isometric view of a thick coal seam illustrating the relation between the first and second phases of a mining operation in accordance with this invention.
Figure 4:
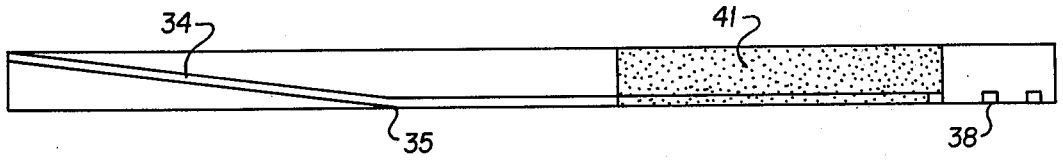
FIG. 4 is a sectional view taken along the line 4—4 in FIG. 3 illustrating the path of the auxiliary panel entries in accordance with this invention.

The second phase of the operation now proceeds by driving auxiliary panel entries, generally represented as entries 34 in FIG. 3, along paths 35 beneath and substantially coincident with the submain entries 10 until the bottom of the seam 12 is reached at a position 36. The panel entries 34 are then driven along the bottom along paths 37 again the boundaries of the development area are approached. As noted in connection with panel entries 14 and 16, the orientation with respect to the horizontal followed by the first and second paths of auxiliary panel entries 34 depends upon the inclination of the seam 12. Interconnecting bleeder entries generally indicated by a numeral 38 will be understood to interconnect a pair of parallel sets of panel entries 34. The panel 39 defined in this manner may now be mined in retreat along the direction of the arrow 40 to a desired position, for example position 35, and in a manner similar to that of the first phase mining operation. Caving of overlying strata will again be induced to form broken gob coal 41 (FIG. 4) so that a substantial recovery will be achieved from the coal underlying the submains 10 and generally falling beneath the area marked by the parallelogram EFGH. Furthermore, if desired, the portion of the seam 12 beneath the submains 10 may be alternatively exploited by driving further auxiliary panel entries (not shown) at right angles to the submains 10 so as to reach and extend along the bottom of the seam 12 until the boundary thereof is reached. Longwalling with sublevel caving may be accomplished as previously described.

The method of the present invention does not require that the submains 10 be driven at the top of the seam 12 if investigation reveals that an intermediate layer within the seam 12 offers a more competent roof. In either event, the described technique for recovering additional coal or other mineral beneath the submains 10 may take advantage of caving of the entire thickness of the seam 12.

While a preferred embodiment of this invention has been described, it will be understood that various changes and modifications can be introduced in the overall mining plan and in the equipment employed without departing from the spirit and scope of such invention as set forth in the claims appended hereto.

The embodiments of the invention in which an exclusive property or privilege is claimed are defined as follows.

1. A method of minimg thick seam underground mineral deposits underlying a competent rock layer comprising the steps of:

a. driving main entries from a portal to the boundaries of the mineral seam to be mined,
b. driving parallel submain development entries from the main entries into the top of the seam so that the rock layer forms the mine roof,
c. driving spaced apart sets of parallel panel entries at right angles to said submain development entries along a first path to the bottom of said seam,
d. continuing said parallel sets of panel entries along a second path coincident with the bottom of said seam until the boundaries of the mining area are reached,
e. connecting the extremities of said panel entries with bleeder entries to define a series of longwall panels to be sequentially mined,
f. mining said panels in retreat under the protection of advancing roof support structures to induce the caving of overlying strata therebehind,
g. driving auxiliary sets of panel entries at right angles to said first set of panel entries beneath and in the same direction as said submain entries,
h. interconnecting said auxiliary sets of panel entries with additional bleeder entries to define an additional longwall panel, and
i. mining said additional longwall panel in retreat so as to induce sublevel caving therebehind.

2. The method of claim 1 wherein said mineral is coal.

3. The method of claim 1 wherein said seam is inclined so that the first path of said panel entries is substantially horizontal.

4. The method of claim 3 wherein said panels are mined in retreat until said second path of said panel entries is tranversed.

5. The method of claim 1 wherein said auxiliary sets of panel entries are substantially coextensive with said submain entries.

6. In a method of longwall mining of a thick underground mineral seam wherein adjacent sets of parallel panel-defining entries are driven into seam between submain entries and bleeder entries to enable longwalling of said panel in retreat followed by sublevel caving, the improvement comprising the steps of:

a. driving said submain entries at a level above the bottom of the seam wherein the roof of said submain entries is competent,
b. sloping said panel entries along a downward path from said level to reach the bottom of the seam at a point intermediate between said submain and bleeder entries, and
c. thereafter continuing said panel entries to the boundary of said seam.

7. The method of claim 6 comprising the additional steps of:

a. driving auxiliary sets of spaced apart panel entries from said submain entries into the portion of said seam underlying said submain entries so as to establish at least one additional panel at the bottom of said underlying portion and
b. thereafter mining said at least one additional panel in retreat accompanied by a further sublevel caving of the overlying strata.

8. The method of claim 7 wherein said auxiliary panel entries are substantially coextensive with said submain entries.

9. The method of claim 7 wherein said auxiliary panel entries are driven at right angles to the direction of submain entries.

* * * * *